US005170573A

United States Patent [19]

Clinch

[11] Patent Number: 5,170,573

[45] Date of Patent: Dec. 15, 1992

[54] MINIATURE POUCH STRING LOCK DEVICE FOR LACES AND THE LIKE

[76] Inventor: Aubrey L. Clinch, 109 Stovall, Ft. Huachuca, Ariz. 85613-7000

[21] Appl. No.: 826,057

[22] Filed: Jan. 27, 1992

[51] Int. Cl.[5] ..... A43B 11/00; A44B 21/00

[52] U.S. Cl. ..... 36/50.1; 24/712.2; 24/715; 24/306

[58] Field of Search ..... 36/50, 112, 136; 24/712, 712.2, 712.4, 713, 715, 715.1, 306, 442

[56] References Cited

U.S. PATENT DOCUMENTS 4,553,293 11/1985 Blum ..... 36/50
4,571,854 2/1986 Edens ..... 36/50
4,780,936 11/1988 Brecher ..... 24/712.2
4,879,787 11/1989 Walls ..... 24/712.2
5,042,119 8/1991 Williams ..... 36/50

FOREIGN PATENT DOCUMENTS 0677029 3/1930 France ..... 24/712.2

*Primary Examiner*—Paul T. Sewell
*Assistant Examiner*—M. D. Patterson
*Attorney, Agent, or Firm*—Richard L. Miller

[57] ABSTRACT

A miniature pouch device which is removably attachable to the instep of a shoe for captivating the lace and bow used to tie the shoe, and retain them in a neat small package which sits in the location where the bow would normally reside on a conventional pair of shoes.

4 Claims, 1 Drawing Sheet

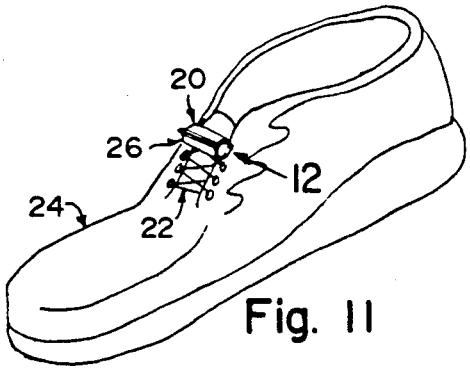
Fig. 11
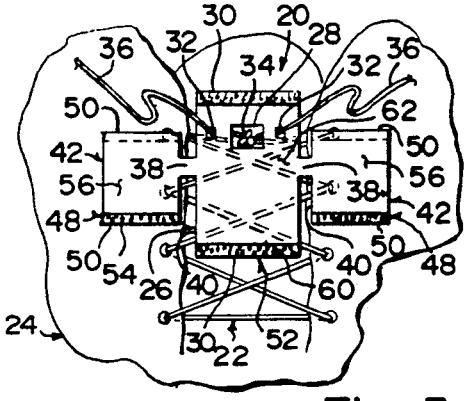
Fig. 3
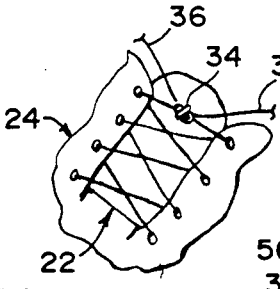
Fig. 1
Fig. 2
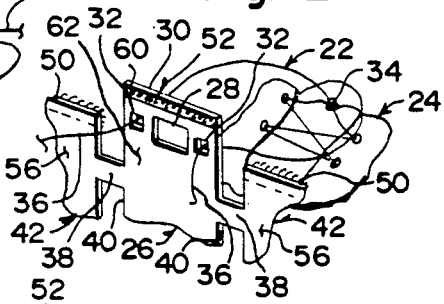
Fig. 4
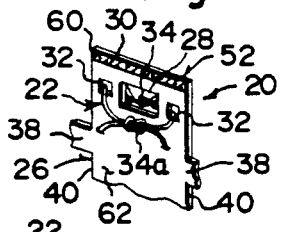
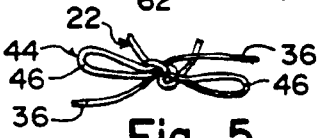
Fig. 5
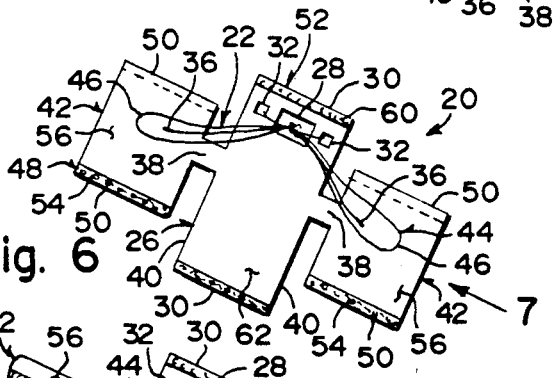
Fig. 6
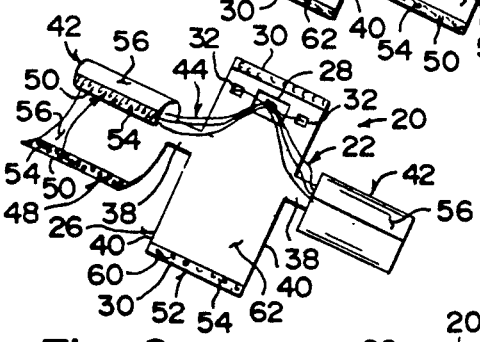
Fig. 8
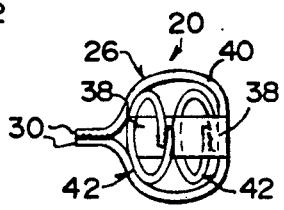
Fig. 12
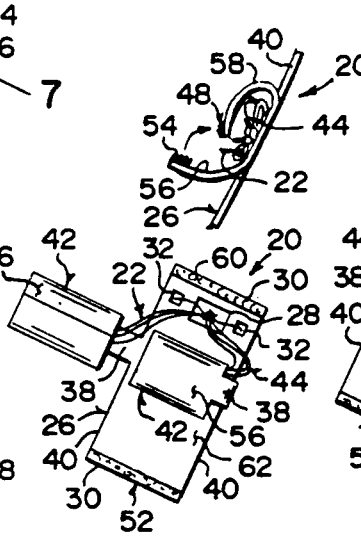
Fig. 7
Fig. 9
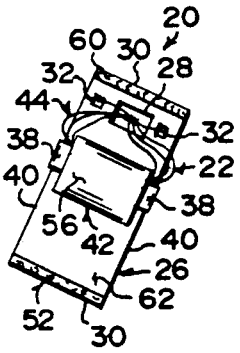
Fig. 10

MINIATURE POUCH STRING LOCK DEVICE FOR LACES AND THE LIKE

BACKGROUND OF THE INVENTION

The instant invention relates generally to shoe fasteners and more specifically it relates to a miniature pouch string lock device for laces and the like.

Numerous shoe fasteners have been provided in the prior art that are adapted to secure shoes to the wearer's feet. For example, U.S. Pat. No. 32,585 to Antonious; U.S. Pat. No. 4,777,705 to Ingram and U.S. Pat. No. 4,907,352 to Ginsberg all are illustrative of such prior art. While these units may be suitable for the particular purpose to which they address, they would not be as suitable for the purpose of the present invention as hereafter described.

SUMMARY OF THE INVENTION

A primary object of the present invention is to provide a miniature pouch string lock device for laces and the like that will overcome the shortcomings of the prior art devices.

Another object is to provide a miniature pouch string lock device for laces and the like that will prevent the laces from coming loose during rigorous athletic activity.

An additional object is to provide a miniature pouch string lock device for laces and the like that will prevent accidents caused by tripping over loose laces and the laces becoming caught or snagged in anything with motion, such as a bicycle chain or the like.

A further object is to provide a miniature pouch string lock device for laces and the like that is simple and easy to use.

A still further object is to provide a miniature pouch string lock device for laces and the like that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows:

FIG. 1 is a diagrammatic perspective view of just the instep portion of a shoe with a lace, showing a first step in a series of steps to install the instant invention thereto;

FIG. 2 is a diagrammatic perspective view of the instep portion of the shoe and a portion of the instant invention, showing a second step;

FIG. 3 is a diagrammatic front view of the instep portion of the shoe and the instant invention, showing a third step;

FIG. 4 is a diagrammatic perspective view of a portion of the instant invention, showing a fourth step;

FIG. 5 is a perspective view of a portion of the lace, showing a fifth step;

FIG. 6 is a diagrammatic front view of the instant invention, showing a sixth step;

FIG. 7 is a diagrammatic end view taken in direction of arrow 7 in FIG. 6, showing a seventh step;

FIG. 8 is a diagrammatic front view similar to FIG. 6, showing an eighth step;

FIG. 9 is a diagrammatic front view similar to FIG. 8, showing a ninth step;

FIG. 10 is a diagrammatic front view similar to FIG. 9, showing a tenth step;

FIG. 11 is a perspective view of the complete shoe, showing an eleventh step being the instant invention completely installed thereto; and FIG. 12 is a diagrammatic enlarged end view taken in direction of arrow 12 in FIG. 11 of just the instant invention per se.

DETAILED DESCRIPTION OF THE PREFERRED EMBODIMENTS

Turning now descriptively to the drawings, in which similar reference characters denote similar elements throughout the several views, the Figures illustrate a miniature pouch string lock device 20 for a lace 22 in a shoe 24, which consists of a rectangular flexible member 26 having a center aperture 28 near one short end 30 and a pair of eyelets 32, with each eyelet 32 positioned on either side of the center aperture 28. When the lace 22 is tied with an overhand tie 34, each free end 36 of the lace 22 can be inserted and pulled through one of the eyelets 32 until the overhand tie 34 is positioned against the center aperture 28 of the rectangular flexible member 26 and a second overhand tie **34*a* is formed. A flexible arm 38 is formed and extends transversely from one opposite long side 40 of the rectangular flexible member 26. A rectangular flexible panel 42 is formed and affixed to one of the flexible arms 38. When the lace 22 is tied into a standard bow 44, one loop 46 and one free end 36 of the lace 22 can extend onto one of the rectangular flexible panels 42. A mechanism 48 is for removably securing the short ends 50 of each rectangular flexible panel 42 together, when each rectangular flexible panel 42 is rolled over the one loop 46 and one free end 36 of the lace 22. A mechanism 52 is for removably securing the short ends 30 of the rectangular flexible member 26 together after the rolled rectangular flexible panels 42 are folded inwardly onto the rectangular flexible member 26 by bending the flexible arms 38, which will prevent the lace 22** from coming loose.

The rectangular flexible member 26, the flexible arms 38 and the rectangular flexible panels 42 are integral and fabricated out of a washable leather/plastic material or the like.

Each first removably securing mechanism 48 includes mating hook and loop pile fastener strips 54, with one said strip 54 affixed to a front surface 56 of the rectangular flexible panel 42 at one short end 50 thereof. Another strips 54 is affixed to a rear surface 58 of the rectangular flexible panel 42 at the other short end 50 thereof, so that the short ends 50 can overlap.

The second removably securing mechanism 52 includes mating hook and loop pile fastener strips 60 with one strip 60 affixed to a front surface 62 of the rectangular flexible member 26 at one short end 30 thereof. Another strip 60 is affixed to the front surface 62 of the rectangular flexible member 26 at other short end 30 thereof, so that the short ends 30 can butt together.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A miniature pouch string lock device for a lace in a shoe which comprises:

a) a rectangular flexible member having a center aperture near a short end and a pair of eyelets, with each said eyelet positioned on either side of said center aperture, so that when the lace is tied with an overhand tie each free end of the lace can be inserted and pulled through one of said eyelets until the overhand tie is positioned against said center aperture of said rectangular flexible member;

b) a pair of flexible arms, each extending transversely from one opposite long side of said rectangular flexible member;

c) a pair of rectangular flexible panels, each affixed to one of said flexible arms, so that when the lace is tied into a standard bow, one loop and one free end of the lace can extend onto one of said rectangular flexible panels;

d) means for removably securing the short ends of each said rectangular flexible panel together, when each said rectangular flexible panel is rolled over the one loop and one free end of the lace; and e) means for removably securing the short ends of said rectangular flexible member together after said rolled rectangular flexible panels are folded inwardly onto said rectangular flexible member by bending said flexible arms which will prevent the lace from coming loose.

2. A miniature pouch string lock device for a lace as recited in claim 1, wherein said rectangular flexible member, said flexible arms and said rectangular flexible panels are integral and fabricated out of a washable material, leather materials and plastic materials.

3. A miniature pouch string lock device for a lace as recited in claim 2, wherein each said first removably securing means includes mating hook and loop pile fastener strips with one said strip affixed to a front surface of said rectangular flexible panel at one short end thereof and another said strip affixed to a rear surface of said rectangular flexible panel at other short end thereof, so that the short ends can overlap.

4. A miniature pouch string lock device for a lace as recited in claim 3, wherein said second removably securing means includes mating hook and loop pile fastener strips with one said strip affixed to a front surface of said rectangular flexible member at one short end thereof and another said strip affixed to the front surface of said rectangular flexible member at other short end thereof, so that the short ends can butt together.

* * * * *